US006606472B1

(12) United States Patent
Mori et al.

(10) Patent No.: US 6,606,472 B1
(45) Date of Patent: Aug. 12, 2003

(54) METHOD AND APPARATUS FOR FORMING COLOR IMAGE

(75) Inventors: Akira Mori, Tsuchiura (JP); Yukio Yamamoto, Tsuchiura (JP); Kazumi Takahashi, Hitachi (JP); Shogo Matsumoto, Tsuchiura (JP); Junichi Matsuno, Tsuchiura (JP); Taisaku Seino, Tsuchiura (JP); Toshio Ogiso, Tsuchiura (JP); Yasushi Kinoshita, Tsuchiura (JP); Keiji Kamio, Hitachi (JP); Kazutaka Sato, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/913,604

(22) PCT Filed: Mar. 17, 1999

(86) PCT No.: PCT/JP99/01316

§ 371 (c)(1),
(2), (4) Date: Aug. 16, 2001

(87) PCT Pub. No.: WO00/55692

PCT Pub. Date: Sep. 21, 2000

(51) Int. Cl.[7] ..... G03G 15/11
(52) U.S. Cl. ..... 399/251
(58) Field of Search ..... 399/237, 241, 399/251, 249, 233; 430/117, 118, 119

(56) References Cited

U.S. PATENT DOCUMENTS

| | | | | | |
|---|---|---|---|---|---|
| 4,286,039 | A | * | 8/1981 | Landa et al. | 430/119 |
| 4,325,627 | A | * | 4/1982 | Swidler et al. | 399/249 |
| 5,028,964 | A | * | 7/1991 | Landa et al. | 399/249 |
| 5,053,823 | A | * | 10/1991 | Oh-ishi et al. | 399/251 |
| 5,136,334 | A | * | 8/1992 | Camis et al. | 399/233 |
| 5,426,491 | A | * | 6/1995 | Landa et al. | 399/237 |
| 5,666,617 | A | * | 9/1997 | Goodman et al. | 399/250 |
| 5,745,826 | A | * | 4/1998 | Chang et al. | 399/237 |
| 5,752,144 | A | * | 5/1998 | Mammino et al. | 399/249 |
| 5,815,779 | A | * | 9/1998 | Abramsohn | 399/249 |
| 5,839,037 | A | * | 11/1998 | Larson et al. | 399/249 |
| 5,970,273 | A | * | 10/1999 | Zenk et al. | 399/12 |

* cited by examiner

*Primary Examiner*—Robert Beatty
(74) *Attorney, Agent, or Firm*—Antonelli, Terry, Stout & Kraus, LLP

(57) ABSTRACT

An image forming device and method utilizing an electrostatic latent image recording medium, developing units reserving different colors for developing images on the recording medium, a dryer for drying the developed images, and an adhesion reinforcer for enhancing adhesion of toner particles including electrostatically pressing dried toner particles against a front surface of the electrostatic latent image recording medium.

28 Claims, 4 Drawing Sheets

METHOD AND APPARATUS FOR FORMING COLOR IMAGE

TECHNICAL FIELD

The present invention relates to a printer which forms a latent image having a density graduation in a unit of pixel, then develops the latent image with fine particle toner in liquid developer used for the development, and transfers the developed image onto regular paper so as to obtain a high resolution image thereon.

BACKGROUND OF THE INVENTION

There have been conventional electrophotography systems such as laser printers, having the following first to fourth configurations:

- a first configuration: steps of forming and developing a latent image on a photosensitive medium and transferring a developed image onto a final recording medium for each color are repeated by a number of times equal to a number of different colors to be used, that is, a plurality of color images are superposed with each other on the final recording medium,
- a second configuration: images for different colors are formed on respective photosensitive mediums which are prepared each exclusively for the respective different colors, and thereafter, the images on the respective photosensitive medium are superposed with each other on a final recording medium;
- a third configuration: latent images are formed on a photosensitive medium for different colors, and are then transferred, for each of colors to be used, onto a secondary image bearing medium such as a dielectric drum or a dielectric belt, so as to successively superposes these images for all colors including a final color on the secondary image bearing medium so as to form a full color image, and the thus formed full color image is transferred onto a final recording medium; and
- a fourth configuration: as disclosed in Japanese Laid-Open Patent No. H8-179600 without using a secondary image bearing medium, a latent image which is formed by an ion writing head is developed with toner that is then cured by an ink curing means using ultraviolet radiation or heat, and after images for different colors are superposed with one another on the primary image bearing medium, the images are then transferred onto a final recording medium in a batch.

However, in the conventional technology, for example, as to a color printer having the first configuration, there has been raised such a problem that the printing speed is low. A color printer having the second or third configuration can solve the above-mentioned problems, but has a complicated large scale structure or an increased number of components.

A color printer having the fourth configuration can solve problems of low printing speed, complicated large scale structure, an increased number of components and the like. However, since the color printer having the fourth structure requires ultraviolet radiation or heat which has to be used for curing toner for respective different colors, there is raised a problem of a large power used during development, which has not yet been solved. In the case of curing toner with the use of heat, it has to cope with a defect in the device which would be caused by a temperature rise due to the heat, and with exhaust heat and the like.

The present invention has been devised in view of the above-mentioned problems, and accordingly, an object of the present invention is to provide a color image forming device which can be small-sized without lowering the printing speed and without increasing the power to be used for development, while can minimize waste heat, and as well to provide a color image forming method therefor.

To the end, according to a first aspect of the present invention, there is provided a color image forming device comprising a latent image recording medium on which a latent image is formed, a plurality of developing units for developing the latent image with the use of liquid developers each having at least toner particles and a solvent, the image developed by the developing units being formed on the recording medium, characterized by a drying means for drying the developed image and an adhesion enhancing means for increasing the adhesion of the toner particles.

The adhesion enhancing means desirably applies an electric field which can exert a force directing toward the latent image recording medium to the toner particles constituting an image after the solvent is evaporated, or a force pressing the toner particles against the latent image recording medium. The adhesion enhancing means may be a means for applying a transcription bias. The means for applying a transfer bias may also serve as a transfer bias supply means in a fixing unit, for transferring and fixing a developed image onto a recording medium.

Further, the above-mentioned image forming device preferably incorporates a charge eliminator for eliminating electric charge from an electrostatic recording medium, in order to eliminate an electric charge to a degree by which the gradation of a latent image is not deteriorated.

Further, according to a second aspect of the present invention, there is provided a color image forming device comprising an electrostatic latent image recording medium for carrying thereon electrostatic images corresponding to image signals, a plurality of developing units for manifesting the latent images for different colors with the use of liquid developers, a drier for drying the images for different colors, developed on the electrostatic latent image recording medium by the developers, and an adhesion enhancing means for enhancing adhesion of toner particles on the electrostatic latent recording medium, dried by the dryer.

The adhesion enhancing means includes an adhesion applying means which may be an electric field generating means for generating an electric field for pressing toner particles constituting color images and dried by the drying means, toward the latent image recording medium. This electric field generating means is preferably a transferring means for applying a transfer bias for transfer. An electrostatic latent image for each color formed on the electrostatic latent image is developed by a developing unit corresponding to the color with the use of a liquid developer. The thus developed image wetted with a solvent is dried by the dryer. The dried image is exposed to the electric field which urges toner particles forming the image toward the electrostatic latent image recording medium, and accordingly, the image can be formed in a stable condition on the electrostatic latent image recording medium. Even though a next latent image is formed and is then developed with a second color on the electrostatic latent image recording medium on which the stable image has been formed, the next image can be stably formed without increasing the power used for the device.

Further, the color image forming device according to the present invention, preferably incorporates a transfer means for transferring, in a batch, a final image which is formed on the electrostatic latent image recording medium and which is developed by superposing different color images with one another, onto a final recording medium. This transfer means preferably includes at least one heating means or one pressuring means for fixing the image simultaneously with the transfer.

Further, the color image forming device according to the present invention may have an electric charge eliminating means which preferably eliminates electric charge within a range in which local chare potential difference on the electrostatic latent image recording medium does not deteriorate the gradation of a latent image formed on the latent image recording medium by the recording head.

Further, the color image forming device according to the present invention preferably uses a liquid developer in which the concentration of toner dispersed therein is from 5 to 35%.

According to the present invention, there is provided a color image forming method characterized by the steps of forming an electrostatic latent image corresponding to an image signal, on an electrostatic latent image recording medium, developing the latent image formed on the electrostatic latent image recording medium with the use of a developer reserved in a developing unit, drying the thus manifested image on the developing latent image recording medium, and enhancing the adhesion of toner particles which constitute the dried image.

In the color imager forming method according to the present invention, the step of enhancing the adhesion of the toner particles preferably conveys the electrostatic latent image recording medium formed thereon the electrostatic latent image into an electric field in which the toner particles forming the dried image is pressed toward the electrostatic latent image recording medium.

According to the present invention, images for different colors which have been obtained by developing latent images can be stably laminated with one another with no color mixing. In the case of superposing developers, that is, images having different colors of toner, with one another, when an image having a second color is formed directly over a dried toner image having a first color, there is caused a problem which should be solved. Detailed description will be made of formation of a second latent image on an electrostatic latent image recording medium on which toner having a first color is merely dried in the form of an image, with the use of a recording head. In this condition, the dried toner on the electrostatic latent image recording medium is attracted toward the recording head by an electric field which is applied between the electrostatic latent image recording medium and the recording head in order to form a new latent image, resulting in a damage to the recording head. In order to prevent occurrence of such a problem, according to the present invention, before the second image is formed over the image formed by the dried toner, the toner is pressed toward the electrostatic latent image recording medium by the electric field. Due to the above-mentioned pressing, the physical adhesion between the toner and the electrostatic latent image recording medium and in the toner can be enhanced, and accordingly, there can be prevented the scattering of toner from the recording head by an electric field, color mixing in the developing part, and the like, thereby it is possible to carry out superposition of the toner images on the electrostatic latent image recording medium only through drying of the liquid developer without curing of toner (melting or solidifying of toner particles).

Further, in the color image forming method according to the present invention, the above-mentioned steps are repeated by several times for different colors, except a final color in the developing unit, and an image for this final color which is developed on the electrostatic latent image recording medium, and is then dried, may be transferred onto a final recording medium.

Further, in the color image forming method according to the present invention, the above-mentioned steps are repeated by several times for different colors, except a final color in the developing unit, and an image for this final color which is developed on the electrostatic latent image recording medium, may be transferred onto a final recording medium without being dried.

BEST MODE OF THE INVENTION

Explanation will be hereinbelow made of an embodiment of the present invention which is illustrated in the accompanying drawings.

Figure 1:
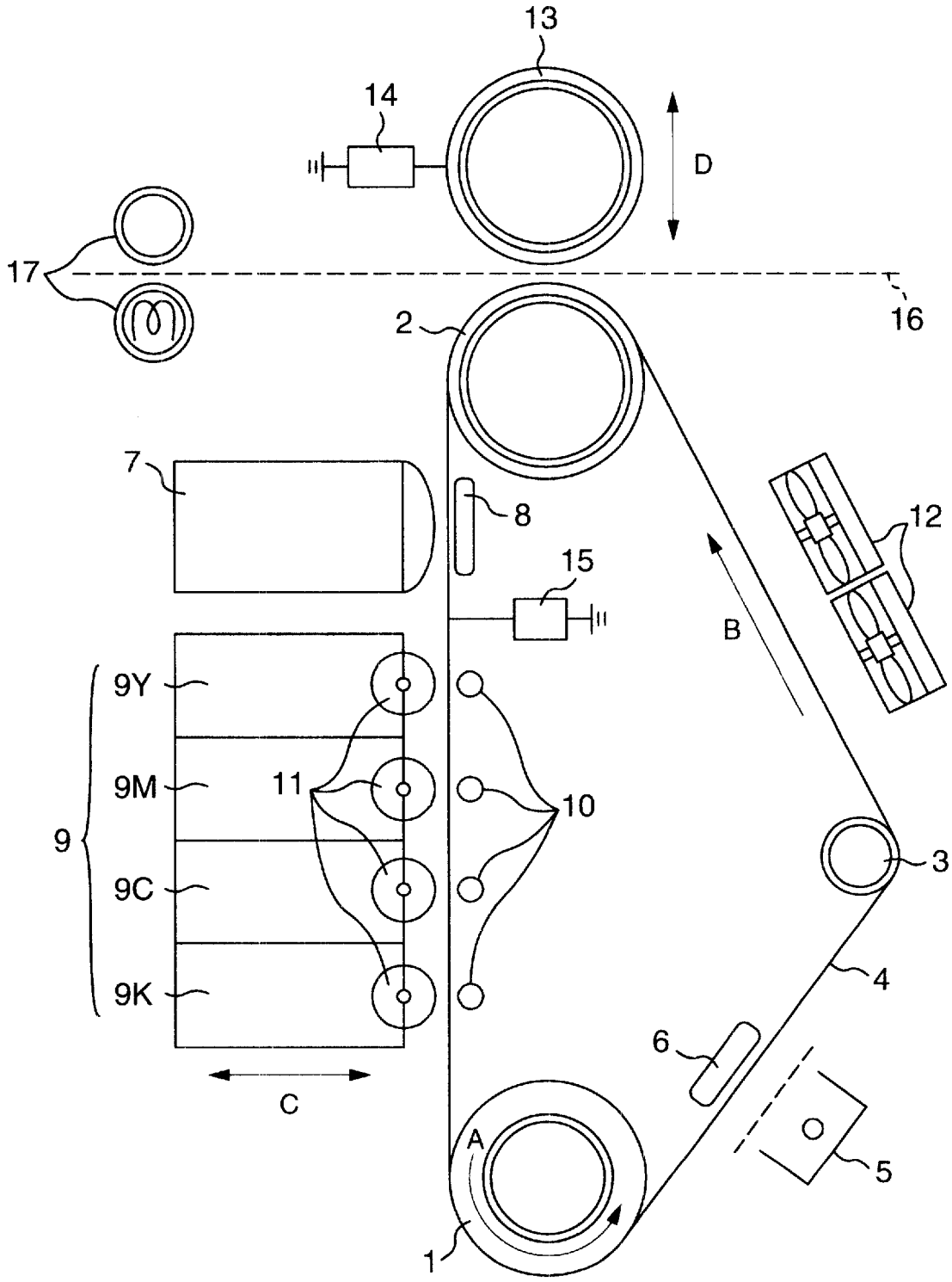
FIG. 1 is a conceptual view illustrating a color image forming device for which a color image forming method in an embodiment of the present invention is applied.

FIG. 1 is a conceptual view which shows a color image forming device for which a color image forming method in an embodiment of the present invention is applied. Three rollers, that is, a drive roller 1 which is driven by a drive power source which is not shown, a driven roller 2 and a tension roller 3, are arranged with their axes are extended substantially in one and the same direction. A dielectric belt 4 is extended being made into contact with these three rollers. This dielectric belt 4 is used as an electrostatic latent image recording medium. The dielectric belt 4 is applied thereto with tension by means of the tension roller 3. As the drive roller 1 is rotated in a direction indicated by the arrow A, the dielectric belt 4 is driven so as to run in a direction indicated by the arrow B. The dielectric belt 4 is composed of at least two layers, that is, a conductive layer and a dielectric layer, the dielectric layer being laid on the front surface side while the conductive layer is laid on the roller side. This conductive layer is electrically connected so as to have a potential equal to that of the three rollers. Further, the potential of the conductive layer is maintained at a predetermined value by means of a belt bias voltage applying means 15.

An electric charge eliminator 5 is provided opposing the surface of the dielectric layer of the dielectric belt 4 running from the drive roller 1 to the tension roller. The charge eliminator 5 has a role of previously setting the potential on the surface of the dielectric layer of the dielectric belt 4 to a value which is substantially equal to a desired potential. The elimination of electric charge by the charge eliminator 5 is controlled such that variation in the potential on the surface of the dielectric belt 4 is held within a range which is substantially 1/10 of a minimum potential range corresponding to a potential difference per one gradation that is created on the surface of the dielectric belt 4 by the recording head 7. In this embodiment, a scorotron charger is used as the charge eliminator 5 in this embodiment, and however, any of those other than the scorotron charge may be used if it can effects the above-mentioned charge elimination. For example, a metal roller is used as the charge eliminator 5 for charge-injection in order to set the potential on the surface of the dielectric belt to a desired potential with a tolerance substantially equal to the above mentioned variation.

A counter electrode 6 which is located making contact with the rear surface of the dielectric belt 4 at a position facing the charge eliminator 5 through the intermediary of the dielectric belt 4, is electrically connected so as to have a potential equal to that of the conductive layer of the dielectric belt 4.

The recording head 7 is located opposing the surface of the dielectric layer of the dielectric belt 4 in a part where the dielectric belt 4 runs from the driven roller 2 to the drive roller 1. A counter electrode 8 is located making contact with the rear surface of the dielectric belt 4 at a position facing the recording head 7 through the intermediary of the dielectric belt 4. This counter electrode 8 is electrically connected so as to have a potential equal to that of the conductive layer of the dielectric layer.

The recording head 7 forms a latent image on the front surface of the dielectric belt 4 in accordance with an image signal for instructing printing, delivered from a host side to the color image forming device. At this time, a gradation per unit pixel can be obtained with the use of a degree of electric charge accumulated on the front surface of the dielectric belt 4. As mentioned above, a minimum potential range of electric charge accumulated on the front surface of the dielectric belt 4 should be sufficiently greater than the variation in potential on the front surface of the dielectric belt 4, which is obtained by charge elimination. In this embodiment, the minimum potential range is set to be about 10 times as large as the variation in potential cased by chare elimination.

Four developing units 9 are arranged in a row, facing the outer surface of the dielectric layer of the dielectric belt 4 in a part where the belt 4 runs the driven roller 2 to the drive roller 1. Further, the developing units 9 are laid, being nearer to the drive roller 1 than to the recording head 7. The developing units 9 are a yellow developing unit 9Y, a magenta developing unit 9M and cyan developing unit 9C and a black developing unit 9K which are arranged in the mentioned order in a direction away from a position near to the recording head. Liquid developers having corresponding colors are reserved in the developing units 9, respectively. The four developing units 9 are selectively displaceable in the direction indicated by the arrow C so that one of them is displaced to a predetermined developing position, depending upon a latent image which is therefore developed. Further, counter electrodes 10 are provided making contact with the rear surface of the dielectric belt at positions facing the developing units 9 through the intermediary of the dielectric belt 4, and are electrically connected so as to have a potential equal to that of the conductive layer of the dielectric belt. Further, the distance between the developing units 9 and the developing roller 11 is preferably set to a critical distance with which a liquid film does not break since color mixing is caused if the distance is too short while no liquid film can be formed if it is too long. This critical distance varies, depending upon a wettability between the dielectric belt 4 and the liquid developer, and between a developing roller 11 and the liquid developer. In this embodiment, the distance between the developing roller 11 and the dielectric belt 4 is substantially set to be slightly smaller than 10 $\mu$m. The development will be detailed later with reference to FIGS. 2 and 4.

A blower 12 serving as a drying means is located, facing the outer surface of the dielectric layer of the dielectric belt 4 in a part in which the dielectric belt 4 runs from the tension roller 3 to the driven roller 4. By driving this blower 12, a solvent in the developer on the dielectric belt 4 is volatized in a short time so as to obtain dried toner. In this embodiment, although explanation has been made such that the blower is used as the drying means, the drying means should not limited to the blower, and any of those which can effect volatilization of the solvent may be used as the drying means.

A pressing roller 13 is located at a position facing the driven roller 2 through the intermediary of the dielectric belt 4. In the embodiment, the pressing roller 13 serves as an electric field creating means for pressing the dried toner particles toward the dielectric belt 4 with the use of electric force, and also serves as a part of a transfer means for transferring an image in which images for different colors including a final color are superposed with one another, onto a final recording medium which is not shown, However, the electric field creating means and the transfer means may be separately provided.

The pressing roller 13 has a conductive elastic layer on its outer surface. Further, the pressing roller 13 is controlled so that an electric field for pressing the dried toner particles is generated between the pressing roller 13 and the conductive layer of the dielectric belt 4 when the pressing roller 13 serves as the electric field forming means by means of a roller bias applying means 14 while a transfer field is generated between the pressing roller 13 and the conductive layer of the dielectric belt 4 when the pressing roller serves as the transfer means. Although effects by the electric field creating means will be detailed later, when the pressing roller 13 serves as the electric field creating means, the dried toner particles is applied with a force toward the dielectric belt 4 due to a created electric field. On the contrary, when the pressing roller 13 serves a part of the transfer means, a force is applied in a direction in which the toner particles go away from the dielectric belt 4.

Next, explanation will be made of a method of forming an image, according to the present invention. At first, the charge eliminator carries our elimination of charge, and accordingly, a predetermined potential is maintained with a predetermined tolerance on the front surface of the dielectric belt 4. Then a latent image is formed on the front surface of the dielectric belt 4 in accordance with an image signal corresponding to a first color by the recording head 7. Then, a developing unit 9 corresponding to this color is displaced toward the dielectric belt 4, and after it reaches its developing position, the development is carried out. At this time, the development is started at a position slightly before the developing unit 9 reaches an image zone on the dielectric belt 4, and the development is completed after a position after it goes across the image zone. Thus, the development can be made without affection upon the image by a transient condition during the formation of a liquid film. After the development, residual electric charge on the dielectric belt 4 is eliminated by the charge eliminator 5 so as to set up a predetermined potential on the front surface of the dielectric belt 4 with a certain tolerance. Through this charge elimination, a gradation per unit pixel can be obtained during formation of an image corresponding to a second color.

Next, a solvent of a liquid development which sticks to the dielectric belt 4, corresponding to the latent image is volatized by the blower 12 as a drying means. Should the image corresponding to the second color be formed in a condition in which the solvent remains, a damage to the recording head 7 or color mixing in the developing unit 9 would be caused. This problem can be eliminated through the drying step and the next step of applying an electric field.

In a condition of an image on the dielectric belt 4 after the volatilization of the solvent in the liquid developer, the toner which has been in the form of a bit of powder is carried on the dielectric belt 4 by a physical adhesion and a weak electrostatic force. Accordingly, should an image corresponding to the second color be formed, the above-mentioned problem would be caused. This problem will be discussed in detail later. In order to solve this problem, in this embodiment, an electric field is effected between the pressing roller 13 and the dielectric belt 4 so as to press the toner particles toward the dielectric belt 4. Since the dielectric belt 4 on which the image is formed by the toner particles is exposed to the electric field, the distance between the toner particles and the distance between the toner particles and the dielectric belt 4 becomes shorter, and accordingly, the physical adhesion between the toner particles and between the toner particles and the dielectric belt 4 is enhanced. The thus created electric field is set to a value less than a half of the discharge initiating electric field of the air since it should not exceed the discharge initiating electric field.

The above-mentioned steps are repeated before an image corresponding to a final color is formed. For the final color, the steps up to the drying step are carried out, and the image is transferred onto a paper sheet by a transfer means. The paper sheet is then conveyed along a transfer path indicted by a dotted line 16 by a conveyer means which is not shown.

In this embodiment, the drying steps for the final color is carried out, and then the transfer is carried out through thermal transfer. However, after elimination of electric charge for the final color, electrostatic transfer may be carried out in a wetting condition. In this case, a transfer voltage is maintained on the outer surface of the pressing roller 13 by a roller bias applying means 14.

Figure 2:
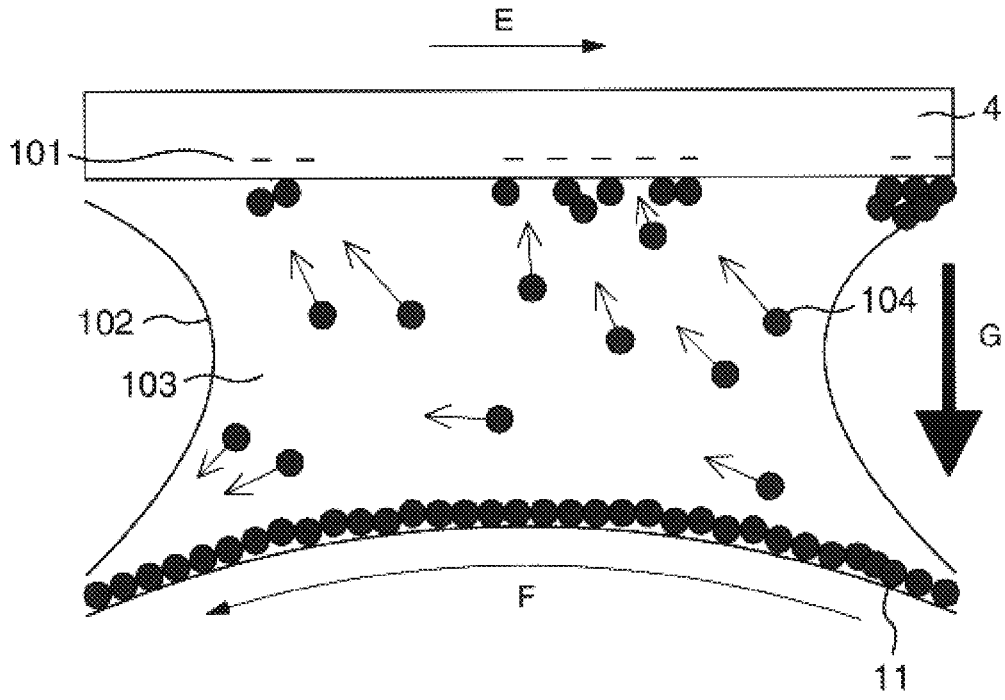
FIG. 2 is a first schematic view for explaining a condition of development in the color image forming device in the embodiment of the present invention.

Next, explanation will be made of the process of the development with reference to FIG. 2 which is a schematic view for explaining a developing condition carried out between the developing unit 9 and the dielectric belt 4. Referring to FIG. 2, a liquid film of a liquid developer 102 is formed between the dielectric belt 4 and the developing roller 11 provided in the developing unit 9. In this embodiment, when the dielectric belt 4 runs in a direction indicated by the arrow E, the developing roller 11 is rotated in a direction indicated by the arrow F. A latent image 101 corresponding to the developing unit 9 is formed in accordance with an image signal on the front surface of the dielectric belt 4. Since a developing bias electric field is applied between the conductive layer of the dielectric belt 4 and the developing roller 11 in a direction indicated by the arrow G, an electrostatic force is exerted to toner particles 104 dispersed in a solvent 103 of the liquid developer 102 in the direction indicted by the arrow G. The toner particles 104 are also exerted thereto with an electrostatic force from the latent image 101 on the front surface of the dielectric belt 4. Accordingly, if the electrostatic force exerted to the toner particles 104 from the latent image 101 on the front surface of the dielectric belt 4 overcomes the electrostatic force exerted to the toner particles by the developing bias electric field, the toner particle 104 sticks to the latent image 101 on the front surface of the dielectric belt 4. If it is not the case, no toner particles stick to the front surface of the dielectric belt 4. Thus, the toner particles 104 sticks to the front surface of the dielectric belt 4 only in a part where the latent image is formed, and accordingly, the development for the latent image can be made.

Figure 3A:
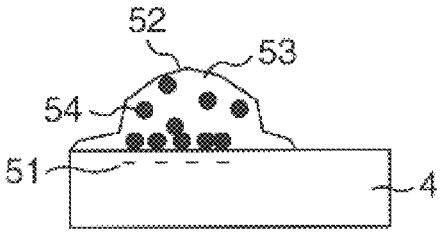
FIGS. 3*a* to 3*d* are first schematic views for explaining conditions of toner particles in the color image forming device in the embodiment of the present invention.

Next, explanation will be made of the effect obtained by pressing the toner particles against the dielectric belt by the electric field creating means with reference to FIGS. 3*a* to 3*d* which are first schematic views for explaining conditions of toner particles. FIG. 3*a* schematically shows a condition of a liquid developer 52 which sticks to the dielectric belt 4 at the time when a latent image is formed and developed on the dielectric belt 4 after electric charge is eliminated from the dielectric belt 4, as viewed in the direction of the section of the dielectric belt. Since electric charge 51 is presented in accordance with an image signal on the front surface of the dielectric belt 4, toner particles which are dispersed in a solvent 53 of the liquid developer 52 in accordance with the electric charge 51 are attracted by an electrostatic force between the toner particles and the electric charge on the front surface of the dielectric belt 4, and accordingly, they stick to the front surface of the dielectric belt 4.

Figure 3B:
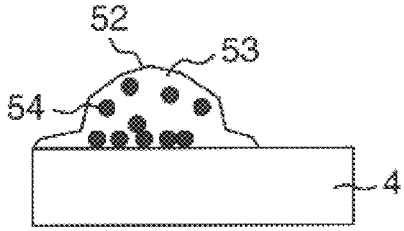

Next, FIG. 3*b* schematically shows a condition which is obtained when the electric charge on the dielectric belt 4 is eliminated by the charge eliminator 5 shown in FIG. 1, as viewed in the direction of the section of the dielectric belt.

Figure 3C:
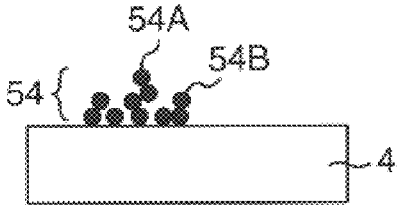

FIG. 3*c* schematically shows a condition in which the solvent 53 of the liquid developer 52 on the dielectric belt 4 is volatized by the blower 12 as the drying means shown in FIG. 1, and accordingly, the dried toner particles 54 stick to the dielectric belt 4, as viewed in the direction of the section of the dielectric belt.

Figure 3D:
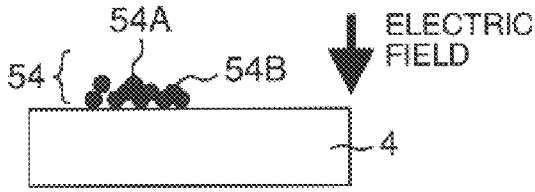

FIG. 3*d* schematically shows a condition in which the adhesion between the dried toner 54 on the dielectric belt 4 and the later and the adhesion between the toner particles 54 are enforced by an electric field generated between the pressing roller 13 serving as the electric field creating means shown in FIG. 1, and the conductive layer of the dielectric belt 4. In the condition after the developed image is dried as shown in FIG. 3c, if the contacts parts between the toner particles as indicated by 54A or between another particles as indicated by 54B, are less, the toner particles stick to the front surface of the dielectric belt 4 or to other toner particles under weak adhesion. Should a latent image corresponding to a second color be directly formed with the use of the recording head 7 shown in FIG. 1, the toner particles as indicated by 54A or 54B which are held under weak adhesion would scatter and accordingly, a disturbance of the image or damage to the recording head would be caused. Further, during development, the toner particles sticking under weak adhesion as indicated by 54A, 54B would cause disturbance of the image, color missing or the like due to a fluid force of a solvent in a liquid developer for a second color.

There has been such a demand that the sticking force between the toner particles stuck under weak adhesion and the front surface of the dielectric belt 4 and the sticking force between the toner particles are enforced. According to the present invention, the toner particles 54 is pressed against the front surface of the dielectric belt 4 by the above-mentioned electric field, that is, the sticking force is enhanced by the electric field creating means in this embodiment.

Next, explanation will be made of superposition of different colors with reference to FIG. 4 and FIGS. 5*a* to 5*d*, in particular, in the case of, for example, a second color.

Figure 4:
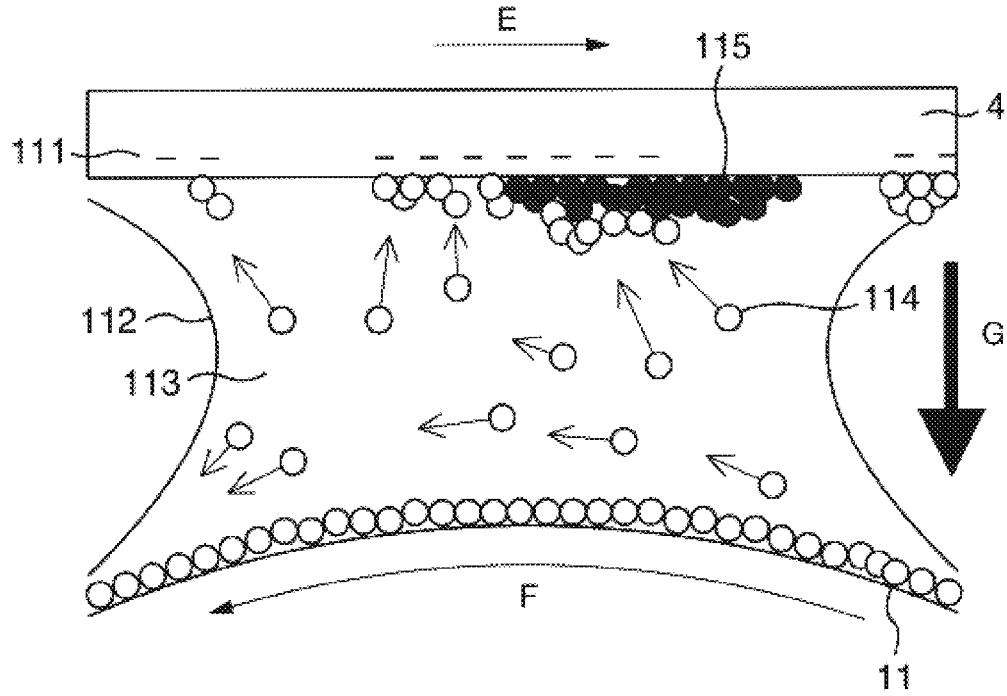
FIG. 4 is a second schematic view for explaining a condition of development in the color image forming device in the embodiment of the present invention.

Referring to FIG. 4 which is a schematic view for explaining the development for the second color, a liquid film of a liquid developer 112 for the second color is formed between the dielectric belt 4 and the developing roller 11. In this embodiment, when the dielectric belt 4 runs in a direction indicated by the arrow E, the developing roller 11 is rotated in a direction indicated by the arrow F. The toner particles 115 of the first color pressed against the front surface of the dielectric belt 4 stick to the front surface of the dielectric belt 4, corresponding to the image signal for the first color. Further, a latent image 111 corresponding to an image signal for the second color is formed on the front surface of the dielectric belt 4. A developing bias electric field is applied between the conductive layer of the dielectric belt 4 and the developing roller 11 in a direction indicated by the arrow G. Since the toner particles 114 are applied thereto with an electrostatic force from the latent image on the front surface of the dielectric belt 4, if the electrostatic force exerted to the toner particles from the latent image 111 on the front surface of the dielectric belt 4 overcomes the electrostatic force exerted to the toner particles 114 by the developing bias electric field, the toner particles stick to the front surface of the toner belt 4, but it is not the case, no toner particles stick to the front surface of the dielectric belt 4. Accordingly, the toner particles stick to a part in which the latent image 111 is formed on the front surface of the dielectric belt 4, that is, the development is carried out only in the part.

The toner particles 115 for the first color are pressed against the front surface of the dielectric belt 4 by the electric field creating means, the positions of the toner particles are restrained from being displaced under affection of the fluid force of the solvent 113.

Figure 5A:
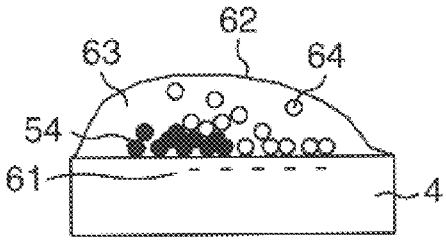
FIGS. 5*a* to 5*d* are second schematic views for explaining conditions of toner particles in the color image forming device in an embodiment of the present invention.
Figure 5B:
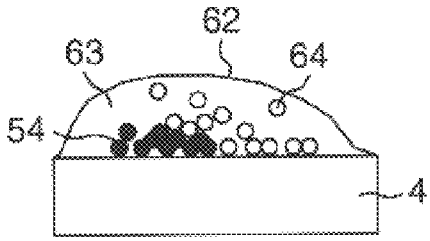
Figure 5C:
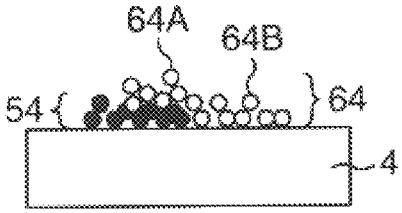
Figure 5D:
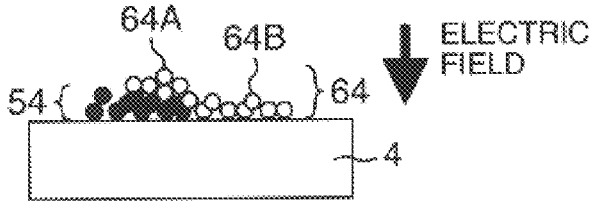

FIGS. 5*a* to 5*d*, show process steps pressing the toner particles against the dielectric belt 4 by the electric field creating means during development for the second color. FIG. 5*a* schematically shows such a condition that, after the toner particles 53 for the first color are pressed against the front surface of the dielectric belt 4 as shown in FIG. 3*d*, a latent image corresponding to an image signal for the second color is formed and developed on the dielectric belt 4, and accordingly, the liquid developer 62 sticks to the dielectric belt 4, as viewed in the direction of the section of the dielectric belt 4. Since electric charge 61 corresponding to the image signal for the second color is present on the front surface of the dielectric belt 4, the toner particles 64 for the second color which are dispersed in a solvent 63 of the liquid developer 62, corresponding to the electric charge 61 stick to the front surface of the dielectric belt 4 or to the toner particles 54 for the first color, being attracted by an electrostatic force between the toner particles for the second color and the electric charge 61 on the front surface of the dielectric belt 4. Next, FIG. 5*b* schematically shows such a condition that the electric charge 61 is eliminated by the charge eliminator 5 shown in FIG. 1, as viewed in the direction of the section of the dielectric belt 4. Further, FIG. 5*c* schematically shows such a condition that the solvent 63 of the liquid developer 62 on the dielectric belt 4 is volatized by the blower 12 as the drying means shown in FIG. 1, and the thus dried toner particles 64 stick to the dielectric belt 4 or to the toner particles 54 for the first color, as viewed in the direction of the section of the dielectric belt 4. Further, FIG. 5*d* schematically shows such a condition that the adhesion between the dried toner particles 64 on the dielectric belt 4 and the latter and adhesion between the toner particles 64 and the toner particle 54 for the first color and between the toner particles 64 are enhanced by an electric field generated between the pressing roller 13 as the electric field creating means and the conductive layer of the dielectric belt 4, as viewed in the direction of the section of the dielectric belt 4. After completion of the drying, toner particles as indicated by 64A and other toner particles as indicated by 64B stick to the front surface of the dielectric belt 4 and to the toner particles 54 for the first color or the other toners 64 only under a weak sticking force. Should the latent image be developed corresponding to the second color with the use of the recording head 7 shown in FIG. 1 as it is, the toner particles indicated by 64A or indicated by 64B would scatter, causing disturbance of the image or damage to the recording head 7. Further, during the development, the toner particle indicated by 64A or 64B sticking under weak adhesion causes disturbance of the image, color mixing or the like due to a fluid force in the liquid developer for the second color. Thus, there is presented such a demand that the toner particles 64 are pressed against the front surface of the dielectric belt 4 under the above-mentioned electric field so as to enhance the sticking force between the toner particles 64 and the front surface of the dielectric belt 4, and between the toner particles. This can be carried out by the electric field creating means in this embodiment.

Subsequent to a third color and up to a final color, the development of the image and the pressing of the toner particles for different colors by the electric field creating means can be made, similar to the steps for the second color.

As mentioned above, according to the present invention, since different colors can be superposed with each other on the electrostatic latent image bearing (recording) medium without melting the toner particles, the color image forming device can be small-sized without lowering the printing speed. Further, generation of extra heat can be minimized without increasing the power to be used, thereby it is possible to provide a color image forming device and a color image developing method which can minimize the generation of extra heat.

What is claimed is:

1. An image forming device having a latent image recording medium on which latent images are formed, a plurality of developing units for developing the latent images with the use of a liquid developer at least consisting of toner particles and a solvent, images developed by the developing units are formed on a recording medium, characterized by a drying means for drying the developed images, and an adhesion reinforcing means for enhancing adhesion of the toner particles of the developed image as dried by the drying means.

2. An image forming device as set forth in claim 1, characterized in that the adhesion reinforcing means generates an electric field for pressing the dried toner particles constituting the developed image from which the solvent is evaporated, toward the latent image recording medium is applied to the toner particles.

3. An image forming device as set forth in claim 2, characterized in that the image forming device is further provided therein with a fixing unit for transferring and fixing the developed image to the recording medium, wherein a transfer bias applying means of the fixing unit is used for enhancing the adhesion of the toner particles.

4. An image forming device as set forth in claim 1, further comprising an electric charge eliminating means for eliminating an electric charge from the electrostatic recording medium within a range in which gradation of a latent image is not deteriorated.

5. A color image forming device characterized by an electrostatic latent image recording medium for carrying thereon latent images corresponding to image signals, a plurality of developing units for developing the latent image for different colors with the use of liquid developers, a dryer for drying the images for different colors, developed on the electrostatic latent image recording medium by the developing units, and an adhesion enhancing means for enhancing adhesion of the toner particles dried by the dryer on the electrostatic latent image recording medium.

6. A color image forming device as set forth in claim 5, characterized in that the adhesion enhancing means incorporates an electric field creating means for creating an electric field which presses toner particles dried by the dryer and constituting images, toward the electrostatic latent image recording medium.

7. A color image forming device as set forth in claim 6, characterized in that the electric field creating means is a transfer means for applying a transfer bias for transfer.

8. A color image forming device as set forth in claim 5, characterized further by a transfer means for transferring, in a batch, an image in which the images for different colors are superposed with each other and developed on the electrostatic latent image recording medium, onto a recording medium.

9. A color image forming device as set forth in claim 5, characterized by an electric charge eliminating means for eliminating electric charge from the electrostatic latent image recording medium within such a range that local potential difference on the electrostatic latent image recording medium after elimination of electric charge does not affect upon gradation of a latent image formed on the electrostatic latent image recording medium.

10. A color image forming device as set forth in claim 5, the toner dispersed in a liquid developer to be used has a concentration of 5 to 35%.

11. A color image forming method for forming a desired color image on a recording medium with the use of liquid developers, characterized by the steps of forming a latent image on an electrostatic latent image recording medium in accordance with an image signal inputted, developing the latent image formed on the electrostatic latent image recording medium with the use of a liquid developer reserved in the developing unit, drying the image developed on the electrostatic latent image recording medium, and enhancing adhesion of toner particles constituting the dried image.

12. A color image forming method as set forth in claim 11, characterized in that the step of enhancing the adhesion of the toner particles transfers the electrostatic latent image recording medium on which the image is formed, into an electric field for pressing the dried toner particles constituting the image, toward the electrostatic latent image recording medium.

13. A color image forming method as set forth in claim 11, characterized in that said steps are repeated for different colors except a final color reserved in a developing unit by several times, an image for the final color is developed on the electrostatic latent image and is then dried, and thereafter, the image developed is transferred onto a final recording medium.

14. A color image forming method as set forth in claim 11, characterized in that said steps are repeated for different colors except a final color reserved in developing units by several times, an image for the final color is developed on the electrostatic latent image and is then transferred onto a final recording medium without being dried.

15. An image forming device comprising:

a latent image recording medium on which a latent image is formed;

a developing unit for developing the latent image with the use of a liquid developer at least consisting of toner particles and a solvent;

a toner image developed by the developing unit being formed on the recording medium;

a drying means for drying the developed toner image; and an adhesion reinforcing means for generating and applying an electric field to the toner particles in the developed image dried by the drying means, for pressing the toner particles so as to enhance adhesion of the toner particles to the recording medium.

16. An image forming device as set forth in claim 15, wherein the adhesion reinforcing means is a pressing roller for pressing the toner image against the recording medium with an electric force after the toner image is dried by the drying means.

17. An image forming device as set forth in claim 15, further including a fixing unit for transferring and fixing the developed image to the recording medium, wherein a transfer bias applying means of the fixing unit is used for enhancing the adhesion of the toner particles.

18. An image forming device as set forth in claim 15, further comprising an electric charge eliminating means for eliminating an electric charge from the recording medium within a range in which gradation of a latent image is not deteriorated.

19. A color image forming device comprising:

an electrostatic latent image recording medium for carrying thereon latent images corresponding to image signals;

a plurality of developing units for developing the latent images for different colors with the use of liquid developers, respectively;

a dryer for drying the images for different colors, developed on the recording medium; and an adhesion enhancing means for applying an electric field to the electrostatic latent images so as to enhance adhesion of particles of a toner in the developed images after the developed images are dried by the dryer on the electrostatic latent image recording medium.

20. A color image forming device as set forth in claim 19, wherein the adhesion reinforcing means is a pressing roller for pressing a toner image against the recording medium with an electric force after the toner image is dried by the drying means.

21. A color image forming device as set forth in claim 19, wherein a first one of the latent images for different colors is developed by a first one of the plurality of developing units with the use of the associated liquid developer, then is dried by the dryer and thereafter is applied with the electric field so as to reinforce the adhesion of the toner particles in the developed and dried image before a second one of the latent images is developed with a second one of the plurality of the developing units.

22. A color image forming device as set forth in claim 19, characterized in that the electric field applying means is a transfer means for applying a transfer bias for transfer.

23. A color image forming device as set forth in claim 19, characterized further by a transfer means for transferring, in a batch, an image in which the images for different colors are superposed with each other and developed on the electrostatic latent image recording medium, onto a recording medium.

24. A color image forming device as set forth in claim 19, characterized by an electric charge eliminating means for eliminating electric charge from the electrostatic latent image recording medium within such a range that local potential difference on the electrostatic latent image recording medium after elimination of electric charge does not affect upon gradation of a latent image formed on the electrostatic latent image recording medium.

25. A color image forming device as set forth in claim 19, the toner dispersed in a liquid developer to be used has a concentration of 5 to 35%.

26. A color image forming method for forming a desired color image on a recording medium with the use of a liquid developer consisting of at least toner particles and a liquid solvent, comprising the steps of:

forming a latent image on a latent image recording medium in accordance with an image signal, developing the latent image with the use of a liquid developer, drying the image developed on the recording medium, and applying an electric field to the toner particles in the developed image so as to press the toner particles against the recording medium after the developed image is dried by the drying means, in order to enhance adhesion of the toner particles to the recording medium.

27. A color image forming method as set forth in claim 26, characterized in that said steps are repeated for different colors except for a final color reserved in a developing unit, with an image for the final color developed on the electrostatic latent image and then dried, and thereafter, the image developed is transferred onto a final recording medium.

28. A color image forming method as set forth in claim 26, characterized in that said steps are repeated for different colors except for a final color reserved in developing units, with an image for the final color developed on the electrostatic latent image and then transferred onto a final recording medium without being dried.

* * * * *